United States Patent [19]

Pettit

[11] Patent Number: 4,527,297

[45] Date of Patent: Jul. 9, 1985

[54] POOL ENTRANCE AND SUPPORTING STRUCTURE

[76] Inventor: Frederick M. Pettit, 1411 Point Abino Rd. S., Ridgeway, Ontario, Canada, L0S 1N0

[21] Appl. No.: 562,415

[22] Filed: Dec. 16, 1983

[51] Int. Cl.[3] ..... E04H 3/18

[52] U.S. Cl. ..... 4/496; 4/506; 4/507

[58] Field of Search ..... 4/506, 492, 544, 541, 4/509, 542, 496, 490, 507, 508, 510, 512

[56] References Cited

U.S. PATENT DOCUMENTS

| | | | |
|---|---|---|---|
| 2,417,499 | 3/1947 | Ille | 4/492 |
| 2,575,636 | 11/1951 | Patch | 4/541 |
| 3,483,863 | 12/1969 | De Vane | 4/507 |
| 3,665,524 | 5/1972 | Jannuzzi, Sr. | 4/507 |
| 3,749,244 | 7/1973 | Jannuzzi, Jr. | 4/507 |
| 3,809,116 | 5/1974 | Sanner | 4/507 X |
| 4,193,143 | 3/1980 | Vienna | 4/509 X |
| 4,233,694 | 11/1980 | Janosko et al. | 4/509 X |

*Primary Examiner*—Henry K. Artis
*Attorney, Agent, or Firm*—Christel, Bean & Linihan

[57] ABSTRACT

A pool entrance and supporting structure which will both provide an entrance or exit from an above-ground pool and will also provide a support for both a skimmer and a return. The pool entrance and supporting structure (40) includes an entrance structure (42). The entrance structure includes a pair of spaced apart ladders (44, 46) and a platform (48) which extends between upper end portions of the ladders. The pool entrance and supporting structure (40) further includes skimmer support means (50) and return support means (52).

By employing the novel pool entrance and supporting structure of this invention improved circulation is achieved within the pool reducing the need for vacuuming, chemicals, and filtering. In addition, the problems encountered with through wall skimmers and returns will be eliminated. Additionally, it will be easier to winterize the pool as the skimmer and return can readily be removed from the pool and stored in an area which will not subject the various components to freezing.

13 Claims, 6 Drawing Figures

Fig. 4.
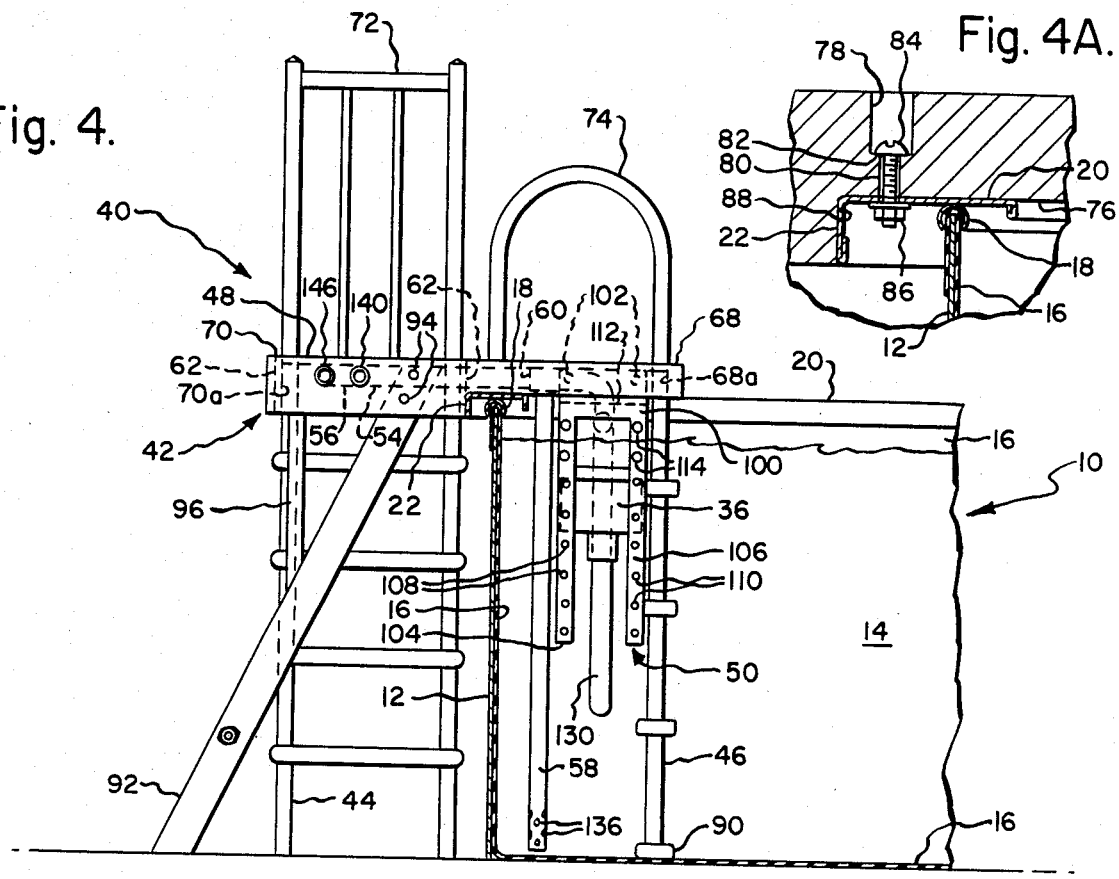
Fig. 4A.
Fig. 5.
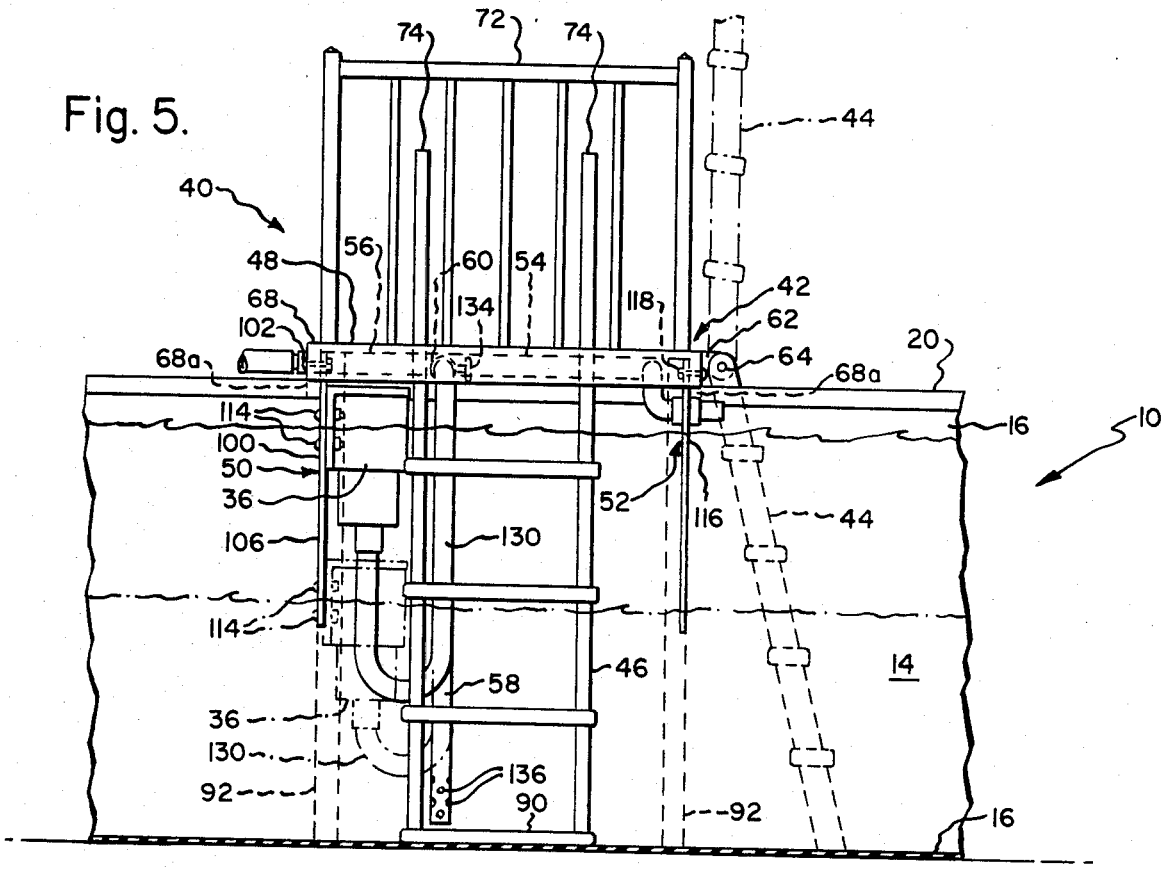

POOL ENTRANCE AND SUPPORTING STRUCTURE

FIELD OF THE INVENTION

The present invention relates generally to above-ground swimming pools, and more particularly to a pool entrance and supporting structure which will provide entrance and/or egress from the above-ground swimming pool and will also provide a support for a skimmer, a return and a pair of hoses which interconnect the skimmer and the return with a pump and filter assembly.

BACKGROUND OF THE INVENTION

It is generally conventional in the above-ground swimming pool art to provide an entrance for the pool and, at separate locations, a skimmer and a return. The entrance may be associated with a deck in which case it consists of an outside ladder to the deck, and another ladder within the pool. Alternatively, it may consist of simply an A frame ladder assembly which extends over the pool wall. The skimmer is customarily mounted in such a manner that it projects through the side of the pool wall and the liner thereof. This is also true of the return.

The relatively standard A frame ladder assembly is customarily supported only at its bottom and tends to be somewhat unstable. While pools provided with a deck to the exterior of the pool have generally stable entrances, these are considerably more expensive than the less expensive A frame entrance.

By having the return and skimmer pass through the liner of the pool, the water flow, during operation of the pump, does not follow the curvature of the pool but has to change directions causing dead spots within the pool. Algae tends to grow in these dead spots and also dirt will settle in dead spots. This requires an increase in filter operation, use of chemicals and vacuuming compared to a pool without dead spots.

In addition, the cutting of the galvanized steel wall of the pool wall as well as the cutting of the vinyl at the location of the skimmer and the return also causes numerous disadvantages. Thus, it is necessary to provide for gaskets to minimize the possibility of leaking in this area. In addition, when galvanized walls are cut to receive the skimmer and return, it leaves raw steel exposed to the cut. This area will rust and cause a weakness in the wall as well as an objectionable rust stain in the area of the skimmer. By having the skimmer mounted in the pool wall it is not possible to fill the pool to its maximum depth. Thus, the water in the pool will not be higher than the center of the skimmer opening, resulting in a total depth of approximately 3 ft. 5 in. in most pools having 4 ft. high walls. Thus, while the pool is sold as a 4 ft. pool it is in fact only 41 inches deep in its normal operation.

In order to prepare the pool for winter, it is desirable to either remove skimmers or insure that no water is left within the skimmer since the freezing of water within a skimmer may cause the skimmer to break. When the skimmer is mounted on the wall it cannot readily be removed because it is difficult to relocate it exactly in the same spot, and thus it is necessary to very carefully service the skimmer to insure that it is entirely empty of water.

In addition ice customarily will build up in a pool over winter. It is quite common where the liner is cut around the skimmer that the liner will tear due to ice slippage when the ice starts to thaw.

OBJECTS AND SUMMARY OF THE PRESENT INVENTION

It is an object of the present invention to provide an improved pool entrance and supporting structure which supports a skimmer and a return and which overcomes the disadvantages of the separate prior art skimmers, returns, and pool entrances.

In accordance with this invention the pool entrance and supporting structure includes an entrance structure having a pair of spaced apart ladders and a platform extending between upper end portions of the ladders, one ladder being disposed externally of the pool wall and the other ladder being disposed within the pool. In addition, the pool entrance and supporting structure also includes a skimmer support means and a return support means which support the skimmer and the return in such a manner that the return is spaced away from the pool wall and has its discharge capable of following the curvature of the pool wall. The skimmer is also spaced away from the pool wall a distance approximately equal to that of the return so that the water within the pool can circulate freely about the pool causing dirt, which is not collected by the skimmer to whirlpool into the center of the pool. The improved circulation achieved by this construction keeps dirt in suspension longer thereby improving the function of the skimmer, reducing dead spots within the pool, and making vacuuming easier. These features will reduce the requirement for chemicals and also required reduced operation of the filter thereby improving the energy efficiency of the system.

It is a further feature of this invention to provide a vertical return line which may be interconnected with the hose which interconnects the skimmer with the pump and filter assembly. The vertical return line will further improve the circulation within the pool. In addition, the vertical return line can also be utilized to draw down the water level in the pool.

The above objects and other objects and advantages of the present invention will become more apparent from a consideration of the following detailed description taken in conjunction with the accompanying drawings in which a preferred form of this invention is illustrated.

BRIEF DESCRIPTION OF THE FIGURES

FIG. 4 is a view taken generally along the line 4—4 in FIG. 3.

FIG. 4*a* is an enlarged detail view of a portion of structure shown in FIG. 4.

FIG. 5 is a view taken generally along the line 5—5 in FIG. 3.

DETAILED DESCRIPTION

Figure 1:
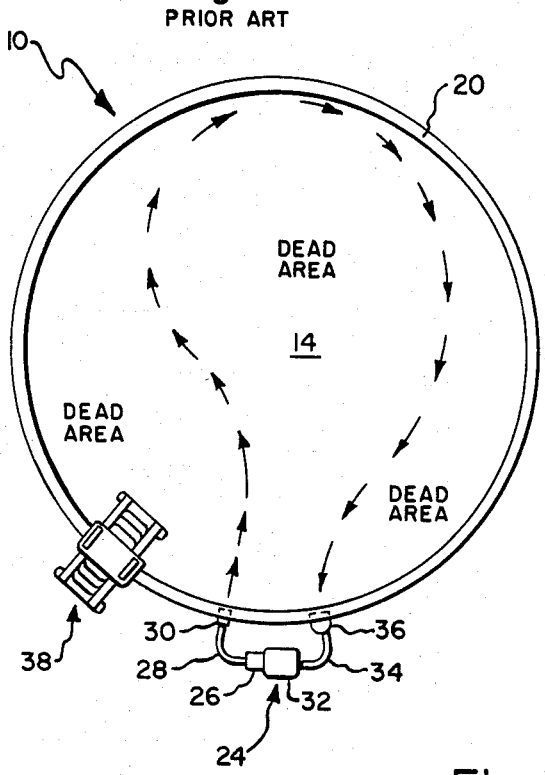
Fig. 1. PRIOR ART
FIG. 1 is a plan view of an above-ground pool which is defined by a generally vertically extending pool wall, provided with a top rail, the pool being provided with an entrance structure and separate through wall returns and skimmers which are both interconnected to a pump and filter assembly. This view also indicates the circulation of the water within the pool during operation of the pump and filter assembly.

In the various views an above-ground pool is indicated generally at 10 and consists essentially of a generally vertically extending pool wall 12 (FIG. 4) which is capable of enclosing a body of water or pool 14. The wall 12 is customarily made of galvanized sheet metal and a liner 16 extends across the floor of the pool and up the sides of the wall 12 and is customarily secured at the top by a bead 18. A top rail 20 is also customarily provided, the top rail having downturned and outer portions 22. A pump and filter assembly, indicated generally at 24, is customarily provided, which pump and filter are customarily secured to a return and a skimmer. In this regard, the pump 26 is secured by means of a hose 28 through a return 30. The prior art return (FIG. 1) projects through the wall 12 and the liner 16 and is secured thereto in a generally conventional manner by suitable fasteners and gaskets. In addition, the filter 32 is connected to a hose 34 which is in turn connected to a skimmer 36. The prior art skimmer projects through an aperture in the sidewall 12 and is secured thereto in a suitable manner by fasteners and gaskets. During the operation of the pump and filter assembly 24 the water within the pool will be drawn into the skimmer 26 and will then pass through hose 34 filter 32 pump 26 and hose 28 and return 30 then being directed out into the pool again. As can be seen from FIG. 1 which illustrated the prior art construction the discharge from the return does not follow the curvature of the pool wall causing dead areas to be created within the pool where there is insufficient water flow. A prior art entrance structure which may be in the form of an A frame ladder assembly indicated generally at 38, is also shown in FIG. 1.

In accordance with the principles of this invention the return and skimmer are supported by a novel pool entrance and supporting structure. One form of pool entrance and supporting structure in accordance with the principles of this invention is indicated generally at 40. The pool entrance and supporting structure includes an entrance structure, indicated generally at 42, the entrance structure including a pair of spaced apart ladders 44, 46 and a platform 48 which extends between upper end portions of the ladders 44, 46. The pool entrance and supporting structure 40 further includes skimmer support means, indicated generally at 52, and a pair of hoses 54, 56. A vertical return line 58 may additionally be provided, the upper end of which is interconnected with one of the hoses by a flow control valve located within T 60.

Referring now in greater detail to the entrance structure 42, which is preferably made of high density polyethylene, it can be seen that one of the ladders 44 is disposed externally of the pool wall, and the other ladder 46 is disposed within the pool. The platform 48 extends between upper end portions of the ladders when they are in their normal working position. In this connection it should be noted that the platform is provided with a pair of ears 62 extending to one side, both of said ears being located outside of the pool, and that the upper portion of the ladder 44 is pivotally secured thereto by means of nuts and bolts 64. The purpose of the pivotal connection is to permit the ladder to be swung to an upper position, indicated by the broken lines in FIG. 5, where it may restrict the access of small children to the pool. The platform can be considered to have three portions, a first portion 66 disposed over the pool wall and top rail 20, a second portion 68 disposed over the surface of the pool 14, and a third portion 70 disposed outside of the pool wall. A fence 72 may be fixed to the third portion and with the ladder 44, when in its raised position, essentially enclose the third portion of the platform. Also rigidly secured to the top of the platform 48 are a pair of handrails 74, the inward ends of which are disposed over the side rails of the ladder 46, the handrails 74 facilitating exiting from the pool 14.

The second portion of the platform 68 is provided with a lower surface 76 which is adapted to rest upon the top rail 20. The first portion is further provided with a pair of fastener receiving recesses, each recess consisting of an enlarged upper cylindrical portion 78 and a lower reduced diameter cylindrical portion 80, there being an annular surface 82 between the two portions 78 and 80. The head of a screw 84 is adapted to rest upon the surface 82, the screw passing through the lower reduced diameter cylindrical portion 78 and a corresponding aperture in the top rail 20 of the pool, and is adapted to be secured thereto by a nut 86. As best shown in FIG. 4A there is a step between the first and third portions of the platform 48, the step providing a vertical surface 88 which is adapted to bear against the outer downturned portion 22 of the top rail 20.

The second portion 68 of the platform 48 has the ladder 46 rigidly secured thereto. The ladder is provided with a base plate 90 which is adapted to rest upon the bottom portion of the liner 16, the ladder 46 thereby supporting the inner end of the platform 48. The third portion 70 of the platform 48 is additionally supported by a pair of inwardly sloping legs 92, the upper ends of which are secured to the third portion 70 of the platform by suitable fasteners 94. The legs are also braced by a brace 96 which extends downwardly from an outermost portion of the third portion 70 to an intermediate portion of each of the legs 92. The legs 92 are also suitably braced by a transverse brace 98 (FIG. 3) the brace 98 being secured to the legs in any conventional manner. It should be obvious at this point that the entrance structure 72 can be readily installed by merely positioning it with the surfaces 88 bearing against the downturned portion of the top rail and then securing it by nuts 86 and screws 84. If the entrance structure 42 is first being installed at a particular location it will of course be necessary to provide suitable apertures in the top rail 20 for the reception of the screws 84.

A skimmer, which may be of a through wall construction, can be suitably secured to the second portion 68 of the platform 48. In this regard, it should be noted that a through wall skimmer is conventionally provided with a planar surface provided with a rectangular opening therein, the surface normally bearing against the outer wall of the pool. A mating plate having a similar rectangular opening is adapted to bear against the inner wall of the pool with gaskets disposed between the inner and outer surfaces of the pool. This skimmer can be utilized in the present invention although it is not necessary to provide the mating plate and the gaskets. In accordance with this invention skimmer supporting means 50 extend downwardly from the second portion 68 of the platform 48, the skimmer supporting means 50 comprising a plastic bracket which is suitably secured to the downturned peripheral portion **68*a* (FIG. 5) by suitable fasteners 102. As can best be seen from FIG. 4** the plastic bracket includes a pair of spaced apart downwardly extending legs 104, 106 each of the legs being provided with a suitable column of spaced apart apertures 108, 110. The bracket further includes an upper member 112 which extends between the legs 104 and 106. As can be appreciated from an inspection of FIG. 5 the skimmer, which is represented by numeral 36, can be secured to the bracket in a raised position wherein suitable fasteners 114 pass through apertures 108, 110 to secure skimmer in its raised position. In this position the skimmer is disposed very close to the top rail 20 of the pool. As the skimmer 36 determines the depth of the water within the pool, and as it may be desirable due to small children, or for other reasons, that the pool not be maintained to the normal height, the skimmer can also be disposed in other positions such as that indicated by the broken line position in FIG. 5.

The return support means 52 also consists of a plastic bracket 116 which is suitably secured by fasteners 118 to the opposite downturned peripheral portion 68*a*. The bracket 116 is provided with a suitable aperture through which the return, indicated at 30, can pass. The return is secured to the bracket 116 in essentially the same manner as it could be secured to the pool wall 12, although it is not necessary to provide gaskets.

Figure 2:
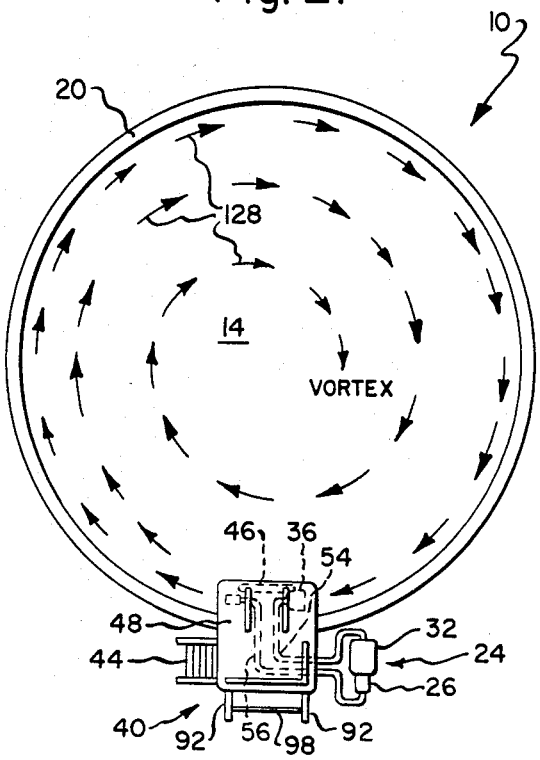
FIG. 2 is a view similar to FIG. 1 but illustrating the novel pool entrance and supporting structure of this invention. This view also indicates the improved circulation of the water within the pool.
Figure 3:
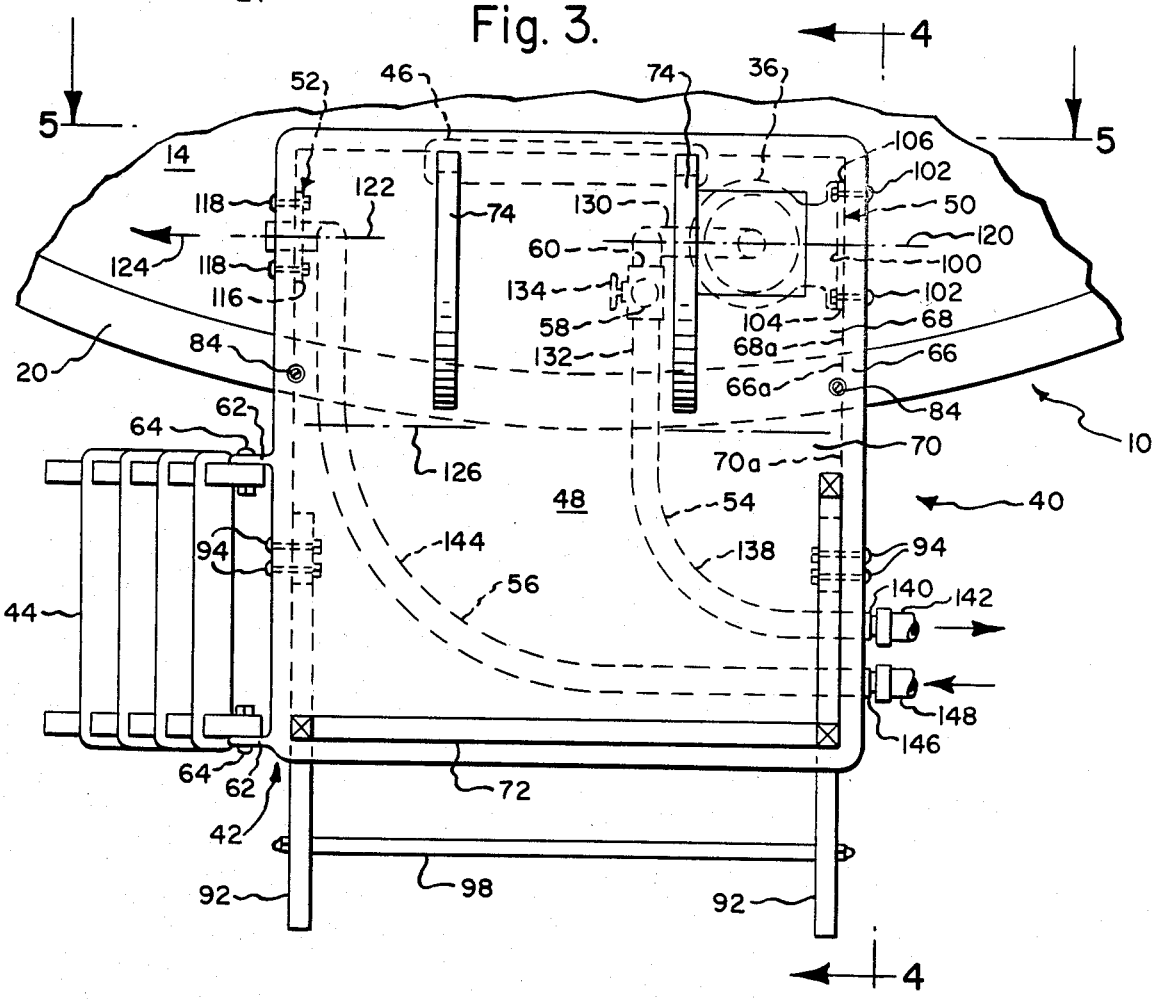
FIG. 3 is an enlarged view of the pool entrance and supporting structure shown in FIG. 2.

As can be seen from an inspection of FIG. 3, the skimmer is supported in such a manner that it is spaced away from the pool wall. In addition, the return is also spaced away from the pool wall and the distance between the pool wall and the centerline for the skimmer, which centerline is indicated by the dot dash line 120 is the same as the distance between the centerline 122 of the return 30 and the adjacent pool wall. It can also be seen from FIG. 3 that the discharge of the return 30, which discharge is represented by the arrow 124, may be parallel to a line 126 tangent to the pool at the center of the entrance structure 42. By the same token the entrance to the skimmer 36 is facing away from the discharge 30. This will cause the water flow within the pool, during the operation of the pump 26, to follow the path indicated by the flow arrows 128 in FIG. 2.

A pair of hoses 54, 56 are carried by the entrance structure. The hose 54 which extends between the skimmer 36 and the filter 32 can be considered to have four parts. The first of the four parts of the hose 54 is that flexible portion which extends from the underside of the platform to the connection portion of the skimmer, this flexible portion being indicated by 130. The flexible portion 130 terminates in another portion which is mounted closely adjacent to the undersurface of the first and second portions of the platform 48, which portion could be rigid and is indicated generally at 132. As can best be seen from FIG. 3, this portion 132 receives the T 60 which receives a flow control valve, the operation of the flow control valve being operated or controlled by a handle 134 or the like. The vertical return line 58 in turn depends from the T 60, the lowermost end of the vertical return line 58 being provided with apertures 136 as well as an open bottom which would facilitate the withdrawing of fluid from a location near the bottom of the pool. The hose 54 can be considered to have a third portion 138 which extends from the second portion 132 to a terminal end portion 140 disposed adjacent a peripheral portion 70*a* of the platform 48. Finally, the hose 54 can be considered to have a fourth portion 142 which extends from the terminal end portion 140 to the filter 32. The other hose 56 can also be considered to include two portions, the first portion 144 of hose 56 extending from the return 30 to a terminal end portion 146 adjacent the terminal end portion 140, and the hose 56 also being considered to have a second portion 148 which extends from the terminal end 146 to the pump 26.

As can be seen from the above, the pool entrance and supporting structure of this invention has been designed not to compare to a through wall skimmer and separate ladder which are available today, but to offer a superior method of entering and exiting from an above-ground pool as well as improving many mechanical functions that the skimmer and return perform.

The pool entrance is more stable than most prior art ladders on the market today as it is wider and the sloping back legs force the surface 88 against the edge 22 of the top rail of the pool keeping the entrance structure 42 from falling backwards or tipping. As can be seen from FIGS. 3 and 4 the base of the legs 92 protrude past the outermost edge of the platform 48 eliminating any tipping that would occur when a heavy person stands on the back of the deck. Because of the support of the legs 92, as well as the inner ladder 48 and the screws and nuts 84, 86, a very stable entrance is provided. In addition, many additional advantages are achieved by mounting the skimmer and the return in the manner indicated.

As can be seen from FIG. 2 during the operation of the pump 26 water exiting from the return will follow the curvature of the pool wall in a natural flow. Thus, the water does not change direction. The fact that better circulation is achieved results in more efficiency as it is not necessary to operate the filter as often to clean the pool. In other words, this design is energy efficient. As the skimmer is attached to the entrance 42 and not to the wall of the pool it is not necessary to operate the filter as often to clean the pool. In other words, this design is energy efficient. As the skimmer is attached to the entrance 42 and not to the wall of the pool it is not necessary to cut the pool wall or liner. This therefore eliminates the need for gaskets, holes in the metal wall of the pool, liner cuts and possible leaks. In addition it also eliminates the possibility of rust when utilized with a steel wall pool. Because the skimmer is mounted on legs 104, 108 which are provided with a plurality of securing apertures 108, 110, it is possible to vary the skimmer height. This therefore allows the skimmer to be raised or lowered to vary the pool depth from approximately 2 ft. deep to approximately 4 ft. deep.

Because the skimmer and return are in line with each other there is more turbulence in the pool. This keeps the dirt particles in suspension longer and the dirt does not have to change directions to go into the skimmer and is therefore pulled into it up to 60% faster. In addition, there are no dead spots around the perimeter of the pool both improving the filtering action of the system and also reducing the need for chemicals. As the circulation causes a whirlpool effect any dirt that does not settle does so in the center of the pool resulting in a small area for vacuuming. This makes it much easier to vacuum the pool and decreases the vacuum time by up to 50%. To winterize the pool it is only necessary to undo the nuts 86, disconnect the exterior hoses 142 and 148 from the terminal end portions 140, 146 and then lift out the entire entrance structure from the pool. By the same token this pool entrance can also be readily assembled and the resulting overall design both reduces the time required to mount a skimmer to a pool and also increases the pool wall life. During the winter ice buildup in the pool and its subsequent slippage in the spring will not cause the pool liner to tear where it has been cut about a skimmer, as no cutting of the liner is required with this form of installation. By attaching the vertical return line 58 to the skimmer return line the overall system can also be used to remove dirt that has settled to the bottom as well as surface dirt. By adjusting the valve within the T 60, the amount of water drawn from the surface and from the bottom of the pool can be readjusted. This permits the overall installation to act as a bottom drain as well as a skimmer. Also, it gives better circulation of water within the pool and will distribute more evenly the chemicals that are added to the water. It achieves this through better circulation at the bottom of the pool and this is done without cutting a hole through the line. By removing dirt through this return line 58 the amount of time required to vacuum the pool, as well as the amount of chemicals that are used to keep the pool clean are reduced even further. Finally, by adjusting the valve it is possible to draw down the level of the pool to a height no greater than the uppermost aperture 136 in the return 58.

It can be seen from the above that many of the disadvantages of prior art constructions have been overcome by the present invention.

While one form of construction has been illustrated, it should be obvious to those having ordinary skill in the art that other forms of construction could be utilized. For example, if it were not desired to have a larger deck area or platform 48 illustrated in these drawings, it would be possible to merely interconnect two ladders with a platform, a portion of which extends over the pool and to which the skimmer and return can be adjustably secured. Such a construction would normally include a sloping ladder which will force a vertical edge of the lower surface of the platform against the rear wall 22 of the top edge of the pool. As other variations of this invention will be apparent to those having ordinary skill in the art it is to be understood that this invention is not to be limited to the particular details shown and described above, but that, in fact, widely differing means may be employed in the broader aspects of this invention.

The return bracket 116 is of the same form as the skimmer bracket to permit the return to be adjusted vertically with the skimmer.

What is claimed is:

1. A pool entrance and supporting structure for an above-ground pool of the type having a generally vertically extending pool wall about the perimeter of a pool, a pump and filter assembly located externally of said generally vertically extending pool wall, and a return and a skimmer adapted to be mounted within said pool; said pool entrance and supporting structure comprising:

an entrance structure including a pair of spaced apart ladders, one of said pair of ladders being disposable outside of an above-ground pool and the other of said pair of ladders being disposable within said pool, and a platform extending between upper end portions of said pair of ladders, said platform having a first portion adapted to be disposed over the generally vertically extending pool wall and a second portion adapted to be disposed over the surface of the pool;

skimmer support means carried by said entrance structure and capable of supporting a skimmer at least in part below said another portion of the platform;

return support means carried by said mounting structure and capable of supporting a return within said pool; and a pair of hoses carried by said entrance structure and capable of interconnecting a skimmer and a return with a pump and filter assembly, a portion of said pair of hoses being supported by said platform and passing over the top of the generally vertically extending pool wall

2. In an above-ground pool of the type having a generally vertically extending pool wall disposed about the perimeter of a pool, a pump and filter assembly located externally of said generally vertically extending pool wall, and a return and a skimmer adapted to be mounted within said pool and interconnected with said pump and filter assembly; the combination therewith of a pool entrance and supporting structure comprising:

an entrance structure including a pair of spaced apart ladders, one of said pair of ladders being disposed externally of said pool wall and the other of said pair of ladders being disposed within said pool, and a platform extending between upper end portions of said ladders when they are in their normal position, said platform having a first portion disposed over the generally vertically extending pool wall and a second portion disposed over the surface of the pool;

skimmer support means carried by said entrance structure and supporting a skimmer at least in part below said another portion of the platform;

return support means carried by said entrance structure and supporting said return within said pool; and a pair of hoses carried by said entrance structure, said pair of hoses interconnecting the skimmer and the return with the pump and filter assembly, a portion of said pair of hoses being supported by said platform and passing over the generally vertically extending pool wall.

3. The pool entrance and supporting structure as set forth in claim 2 wherein said platform is provided with a third portion disposed outside of said pool wall, and further characterized by the provision of a pair of sloping legs whose upper ends are more closely adjacent the vertically extending pool wall than the lower ends, said legs supporting said third portion.

4. The pool entrance and supporting structure as set forth in claim 3 wherein the platform is provided with a generally vertically extending surface which is adapted to bear against an upper outer surface of said generally vertically extending pool wall, the generally vertically extending surface extending downwardly from the first portion of the platform.

5. The pool entrance and supporting structure as set forth in claim 3 wherein said one ladder is movable to a raised inoperative position where it partially fences said third portion of said platform, and further characterized by the provision of a fixed fence disposed in part about said third portion of the platform, said one ladder and said fixed fence substantially enclosing the perimeter of the third portion which is outside of said pool wall.

6. The pool entrance and supporting structure as set forth in claim 2 further characterized by the provision of a pair of spaced apart fasteners which secure the entrance structure to the generally vertically extending pool wall.

7. The pool entrance and supporting structure as set forth in claim 2 wherein the return is supported in such a manner by the return support means that it has its discharge flow parallel to the adjacent pool wall.

8. The pool entrance and supporting structure as set forth in claim 2 wherein said return is supported in such a manner that its dischage is spaced away from the pool wall and has its discharge flow parallel to said pool walls, and wherein said skimmer is mounted approximately the same distance away from said pool wall.

9. The pool entrance and supporting structure as set forth in claim 8 wherein said skimmer entrance faces away from said return.

10. The pool entrance and supporting structure as set forth in claim 2 wherein said skimmer support means is capable of supporting said skimmer at varying heights.

11. The pool entrance and supporting structure as set forth in claim 10 wherein said skimmer supporting means includes generally vertically extending means having two vertically extending columns of spaced apart apertures to which the skimmer may be adjustably secured.

12. The pool entrance and supporting structure as set forth in claim 2 wherein the hose which interconnects the skimmer to the pump and filter assembly is provided with a T, and further characterized by the provision of an additional generally vertically extending return line the upper end of which is interconnected with said T, and the lower end of which is disposed closely adjacent the bottom of said pool.

13. The pool entrance and supporting structure as set forth in claim 12 further characterized by the provision of a flow control valve associated with said T and capable of controlling the flow from the skimmer and the bottom of the pool to the pump and filter assembly.

* * * * *